US006206363B1

(12) United States Patent
Vedoy et al.

(10) Patent No.: US 6,206,363 B1
(45) Date of Patent: Mar. 27, 2001

(54) CATCH TRAY ATTACHMENT FOR SHEET FEEDING MACHINE

(75) Inventors: Arild Vedoy, White Bear Lake; Mark Nordling, Crystal, both of MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 0 days.

(21) Appl. No.: 09/428,829

(22) Filed: Oct. 28, 1999

(51) Int. Cl.[7] ..... B65H 43/00

(52) U.S. Cl. ..... 271/176; 271/199; 271/220; 271/223; 271/3.17; 235/98 C; 377/8

(58) Field of Search ..... 271/176, 199, 271/220, 223, 265.01, 3.17, 4.03, 7; 235/98 R, 98 B, 98 C; 377/8

(56) References Cited

U.S. PATENT DOCUMENTS 5,033,731 * 7/1991 Looney ..... 271/220
5,228,679 * 7/1993 Borostyet ..... 271/220
5,321,236 * 6/1994 Akioka et al. ..... 271/3.17
5,815,592 * 9/2000 Mennie et al. ..... 271/176
6,050,563 * 4/2000 VeDoy et al. ..... 271/35
6,113,094 * 9/2000 Horiguchi et al. ..... 271/176

* cited by examiner

*Primary Examiner*—H. Grant Skaggs
(74) *Attorney, Agent, or Firm*—Nikolai, Mersereau & Dietz, P.A.

(57) ABSTRACT

A catch tray attachment for a sheet feeding machine allows rapid accumulation and manual removal of a predetermined count of sheet articles from the catch tray. The catch tray itself is adapted for mounting to the frame of the sheet feeding machine so as to position it in the discharge path of sheet articles exiting the sheet feeder. Upon removal of an accumulation of sheet articles from the catch tray, a signal is sent back to the sheet feeder to initiate further machine cycles whereby a predetermined count of sheet articles are again deposited in the catch tray.

8 Claims, 1 Drawing Sheet

CATCH TRAY ATTACHMENT FOR SHEET FEEDING MACHINE

BACKGROUND OF THE INVENTION

I. Field of the Invention

This invention relates generally to sheet feeding equipment wherein a predetermined number of sheet articles may be fed, one at a time, from the bottom of a stack of sheet articles in a hopper, and more particularly to a catch tray assembly adapted to be attached to the frame of the sheet feeding machine downstream of the discharge in which the predetermined number of sheets can be accumulated and readily removed as a unit and where the removal of the sheet articles activates the sheet feeding machine for another cycle.

II. Discussion of the Prior Art

In our co-pending application Ser. No. 09/032,825, filed Mar. 02, 1998, and entitled "Sheet Feeder", now U.S. Pat. No. 6,050,563, there is described an improved friction sheet feeder for feeding sheet-like articles, such as paper sheets, paper cards, plastic sheets or other flat products from a stack of such sheets contained in a hopper, one a time. The contents of that application are hereby incorporated by reference. The machine therein described is a readily suited to dealing out individual sheet articles to a collating conveyor where other sheet articles distributed from a different sheet feeder are combined to form a booklet or the like.

In certain applications, it is desirable to be able to rapidly accumulate a predetermined count of identical sheet articles for later boxing or packaging. Consider the case of greeting cards. A greeting card publisher may often wish to box or wrap 20 greeting cards and 20 envelopes as a unit. Sheet feeding equipment of the type described in applicant's above-referenced co-pending application can readily be programmed to deal out 20 cards while a second such machine deals out 20 envelopes. When this is to be done on a repetitive basis and with a human operator taking the groups of 20 cards and 20 envelopes and placing them together for further processing, e.g., wrapping or boxing, it would be advantageous to have the removal of a set from a receptacle initiate another cycle of the sheet feeding machine so that as a first set is being inserted by an operator into a box, the sheet feeder can already be dealing out another set of sheet articles.

The present invention meets that need. By providing an accessory attachment for a sheet feeding machine that is electronically tied to the sheet feeder's motor controller, a signal can be sent to the sheet feeder to activate it for a predetermined number of sheet delivery cycles upon the removal of sheet articles from a catch tray.

SUMMARY OF THE INVENTION

The present invention comprises a catch tray attachment for a sheet feeding machine of the type comprising a frame, an endless feed belt and a feed belt drive motor structure supported by the frame for driving an upper flight of the endless belt in a forward direction. Positioned above the upper flight of the endless belt is a hopper that supports a stack of sheet articles such that the lowermost sheet article in the stack contacts the upper flight of the endless belt. A stripper wheel cooperates with the upper flight to block all but the lowermost sheet article from passing between the stripper wheel and upper flight along a discharge path. The sheet feeding machine with which the catch tray is used further includes a microcomputer-based control circuit for controlling the drive motor structure.

The catch tray itself comprises a tray member having a generally planar base with first and second sides projecting perpendicularly to the base where each of said sides includes a longitudinal extension adapted for connection by bolts or the like to the frame of the sheet feeding machine so as to locate the tray member downstream of the discharge point of the sheet feeding machine. A stop assembly is suspended between the first and second sides and includes a stop member that is disposed in the discharge path of the sheet articles exiting the sheet feeding machine to cause sheet articles to drop onto the base ahead of the stop members. A sensor, such as a photo eye, is mounted on the base for detecting the removal of sheet articles from a resting position on the base and sending a control signal to the control circuit of the sheet feeding machine for restarting the motor a predetermined time after sheet articles fed from the sheet feeder are removed from the catch tray.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DISCUSSION OF THE PREFERRED EMBODIMENT

Figure 1:
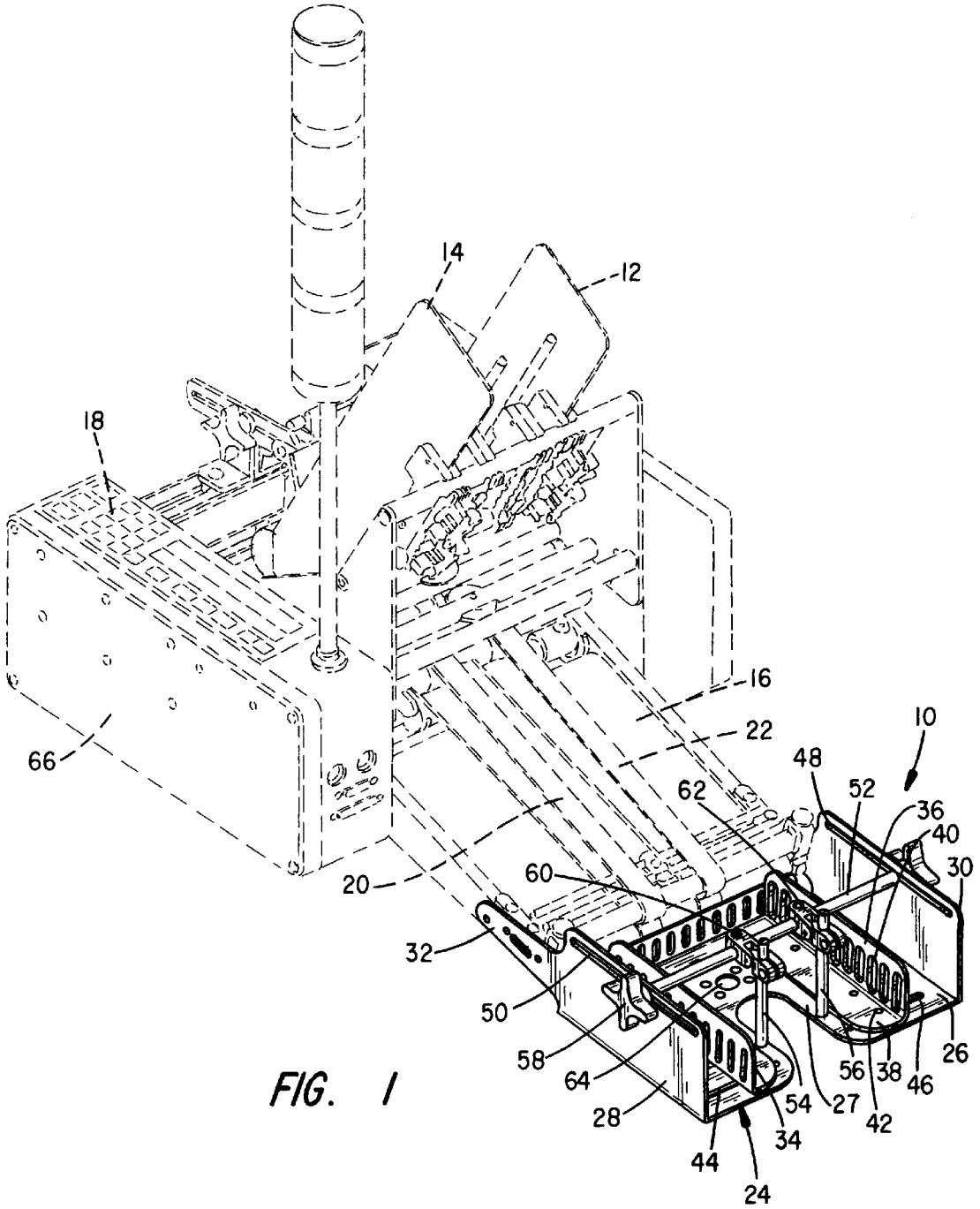
FIG. 1 is a perspective view of the catch tray of the present invention attached to the discharge structure of a prior art sheet feeding machine.

Referring to FIG. 1, the catch tray of the present invention is shown in solid line form and is identified generally by numeral 10. It is shown as being attached to the discharge end of the sheet feeder described in the aforereferenced application Ser. No. 09/032,825, now U.S. Pat. No. 6,050,563, and which is shown in phantom line representation in FIG. 1. As is explained in that application, a stack of relatively flat items can be placed in the hopper defined by side guides 12 and 14 and then fed, one-at-a-time, from the bottom of the stack through a gap defined by shaft-mounted stripper wheels onto the discharge conveyor 16 to which the catch tray attachment 10 is affixed. By appropriate entries on the keypad 18, the sheet feeder can be made to "deal out" a predetermined number of sheet articles and then stopped. As the sheet items leave the discharge belts 20 and 22 of the discharge conveyor 16, they are made to fall within the catch tray 10.

The catch tray itself is seen to comprise a tray member 24 having a generally planar base 26 with a U-shaped cut-out 27 extending inward from the front edge thereof and with first and second sides 28 and 30 formed so as to project perpendicularly from the base 26. Each of the sides 28 and 30 includes a longitudinal extension, as at 32, which extensions are adapted to be affixed by bolts to the frame of the sheet feeding machine to thereby locate the tray member 24 downstream of the sheet feeder's stripper wheels which define the gap through which the sheet articles exit the sheet feeding machine. More particularly, and as shown in FIG. 1, the longitudinal extensions of the sides 28 and 30 attach to the opposed sides of the opposed sides of the discharge conveyor 16.

Mounted on the base 26 are sheet guides 34 and 36 which can be laterally adjusted to accommodate sheets of varying width therebetween. Specifically, the guides 34 and 36 each include a horizontal base portion 38 and a vertical side wall 40 that is bent at a perpendicular angle to the base portion. Extending through the base portion are clamping screws, as at 42, that pass through transversely extending slots 44 and 46 formed in the base 26. Wing nuts (not shown) are threaded onto the bolts 42 and serve to clamp the guides 34 and 36 with a desired spacing therebetween.

The walls 40 of the guides 34 and 36 include a plurality of vertical slots to provide relief for air that is displaced by falling sheets to thereby decrease the sheet's settling time, all as will be further explained.

The sides 28 and 30 of the catch tray 10 each include a longitudinal slot 48 and 50 that extend substantially the entire length thereof A stop assembly comprising a transversely extending rod 52 and pivotally mounted stop members 54 and 56 is suspended from the tray by virtue of threaded ends on the rod 52 that are of reduced diameter so as to fit through the slots 48 and 50. Threaded knobs as at 58 attach to the ends of the rod and can be used to clamp the rod at a desired position along the length of the grooves 48 and 50. The stop members 54 and 56 are pivotally coupled to the transversely extending support rod 52 by means of couplings 60 and 62.

Formed through the base 26 at a location inward of the cut-out 27 is a circular aperture and positioned within or beneath this aperture is a photo-eye sensor 64 that is electrically connected to the motor control circuit board contained within the box-like housing 66 of the sheet feeding machine.

OPERATION

In use, the catch tray attachment 10 comprises a device for accumulating a given number of sheet articles dispensed from the sheet feeder. The guides 34 and 36 are initially positioned relative to one another on the base 26 so as to receive sheet articles of a given size therebetween. The stop assembly is positioned along slots 48 and 50 to accommodate the length of the sheets. The number of sheets to be grouped is entered on the keypad of the sheet feeder. Upon actuation of a start button on the sheet feeding machine, sheets are fed, one-at-a-time, from the bottom of a stack of such sheets contained in the sheet feeder's hopper and are conveyed at a predetermined, relatively high speed by the discharge belts 20 and 22 such that the sheet articles are carried by inertia until the leading edge thereof strike the stop members 54 and 56 and then fall to the bottom of the tray between the walls of the guide member. As the sheets fall, the air displaced is free to exit the plurality of slots 40 formed through the walls of the guides, thus allowing the sheets to rapidly fall one atop the other until the predetermined count of such sheets has been reached. When that number is delivered down the discharge conveyor 16, the sheet feeder motor is shut off. An operator may now reach his/her hand between the stop members 54 and 56 and through the U-shaped cut-out 27 to grasp the group of sheet articles resting in the tray. By pulling them in the forward direction against the stops 54 and 56, the stops will pivot counterclockwise (when viewed in FIG. 1) allowing the group to be extracted. As the group is removed from the tray, the photoeye in the aperture 64 becomes uncovered and sends a signal to the motor control board in the sheet feeder which causes the sheet feeder's drive motor to again become energized to deliver a further grouping of sheet articles into the catch tray 10. The programming is such that a certain time delay, such as one second, must elapse between the uncovering of the photoeye and the energization of the motor to ensure that the previous group of articles has been manually extracted from the tray and is out of the way before initiating formation of the next set. Upon extraction of a set, the stop members 54 and 56 pivot either under the force of gravity, or by virtue of a spring, back to their blocking orientation illustrated in FIG. 1.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself

What is claimed is:

1. A catch tray attachment for a sheet feeding machine of the type comprising a frame, an endless feed belt and a feed belt drive motor structure supported by the frame for driving an upper flight of the endless belt in a forward direction, a hopper disposed above the upper flight for supporting a stack of sheet articles with the lowermost sheet article in the stack contacting the upper flight, a stripper wheel cooperating with the upper flight to block all but the lowermost sheet article from passing between the stripper wheel and the upper flight along a discharge path, and a control circuit controlling said drive motor structure, said catch tray comprising:

(a) a tray member with a generally planar base having first and second sides projecting perpendicularly to the base, each said side including a longitudinal extension adapted for connection to the frame of the sheet feeding machine to locate the tray member downstream of the stripper wheel;

(b) a stop assembly suspended between the first and second sides and including a stop member disposed in the discharge path of the sheet articles exiting the sheet feeding machine; and (c) a sensor mounted on the base for detecting the removal of sheet articles from a resting position on the base and sending a control signal to the control circuit of the sheet feeding machine for starting the drive motor structure a predetermined time after sheet articles fed by the sheet feeding machine are removed from the catch tray.

2. The catch tray of claim 1 wherein the stop assembly is longitudinally positionable along a length dimension of the first and second sides.

3. The catch tray of claim 2 wherein the first and second sides include horizontal slots and said stop assembly comprises an elongated rod having means extending through said slots for clamping the rod to the sides at a desired location there along.

4. The catch tray of claim 3 wherein the stop member comprises at least one finger pivotally supported on the elongated rod and depending there from to a position in alignment with the discharge path of the sheet feeding machine.

5. The catch tray of claim 4 and further including means for biasing the at least one finger to said position.

6. The catch tray of claim 1 and further including:

(a) first and second sheet article guides positionably mounted to the base of the tray member.

7. The catch tray of claim 1 wherein the base includes an opening extending inwardly from a front edge thereof to facilitate manual grasping of sheet articles resting on the base.

8. The catch tray of claim 7 wherein the sensor comprises a photocell mounted in the base in alignment with and proximate to an end of the opening.

* * * * *